US011529677B2

(12) United States Patent
Steen et al.

(10) Patent No.: US 11,529,677 B2
(45) Date of Patent: Dec. 20, 2022

(54) VACUUM SENSOR SYSTEM FOR HIGH PRESSURE DIE CASTING

(71) Applicant: Midland Technologies, Inc., Rogers, MN (US)

(72) Inventors: Mark Dana Steen, St. Anthony, MN (US); William Frank Zbaracki, Otsego, MN (US); Ray Edwin Hammermeister, Waverly, MN (US); Brian Christian Hannah, Crystal, MN (US)

(73) Assignee: Midland Technologies, Inc., Rogers, MN (US)

( * ) Notice: Subject to any disclaimer, the term of this patent is extended or adjusted under 35 U.S.C. 154(b) by 0 days.

(21) Appl. No.: 17/451,783

(22) Filed: Oct. 21, 2021

(65) Prior Publication Data

US 2022/0032363 A1 Feb. 3, 2022

Related U.S. Application Data

(62) Division of application No. 16/906,456, filed on Jun. 19, 2020, now Pat. No. 11,179,772.

(60) Provisional application No. 62/864,212, filed on Jun. 20, 2019.

(51) Int. Cl.
*B22D 17/14* (2006.01)
*B22D 17/32* (2006.01)

(52) U.S. Cl.
CPC ..... *B22D 17/145* (2013.01); *B22D 17/14* (2013.01); *B22D 17/32* (2013.01)

(58) Field of Classification Search
CPC ..... B22D 17/14; B22D 17/145
See application file for complete search history.

(56) References Cited

U.S. PATENT DOCUMENTS

| | | | |
|---|---|---|---|
| 5,511,605 | A | 4/1996 | Iwamoto |
| 5,782,287 | A | 7/1998 | Iwamoto et al. |
| 10,016,809 | B2 | 7/2018 | Saida |

(Continued)

FOREIGN PATENT DOCUMENTS

| | | | |
|---|---|---|---|
| CN | 101954470 | A | 1/2011 |
| CN | 102145381 | B | 6/2012 |

(Continued)

*Primary Examiner* — Kevin E Yoon
(74) *Attorney, Agent, or Firm* — Kinney & Lange, P.A.

(57) ABSTRACT

A vacuum sensor system includes a vacuum pump, vacuum tank, solenoid valve, filters, vacuum block, sensors, and a central processing unit (CPU). The vacuum sensor system monitors the performance of a vacuum system connected to a high pressure die casting machine to ensure that the components cast in the mold or die will have a greater yield of acceptable parts. More specifically, the vacuum sensor system uses sensors to monitor and analyze the vacuum pressure at multiple locations to determine which components are clogging and causing a loss of vacuum pressure in the system. When the CPU detects an anomaly in the pressure, the CPU provides notification in one or more of the following ways: sending a command to shut down the die casting machine; visual notification on the screen of the CPU; an audible warning signal; a visual notification on a semaphore installed on the machine; and/or an electronic notification to one or more users via email, text, or other form of telecommunication.

20 Claims, 1 Drawing Sheet

(56) References Cited

U.S. PATENT DOCUMENTS

| | | | |
|---|---|---|---|
| 2016/0167128 | A1 | 6/2016 | Stalder |
| 2019/0255604 | A1 | 8/2019 | Werner et al. |

FOREIGN PATENT DOCUMENTS

| | | | | | |
|---|---|---|---|---|---|
| CN | 102950270 | A | * | 3/2013 | ..... B22D 17/145 |
| CN | 108480597 | A | * | 9/2018 | ..... B22D 17/14 |
| DE | 102019100282 | A1 | | 7/2020 | |
| EP | 1057559 | A1 | | 12/2000 | |
| WO | 2018082939 | A2 | | 5/2018 | |

* cited by examiner

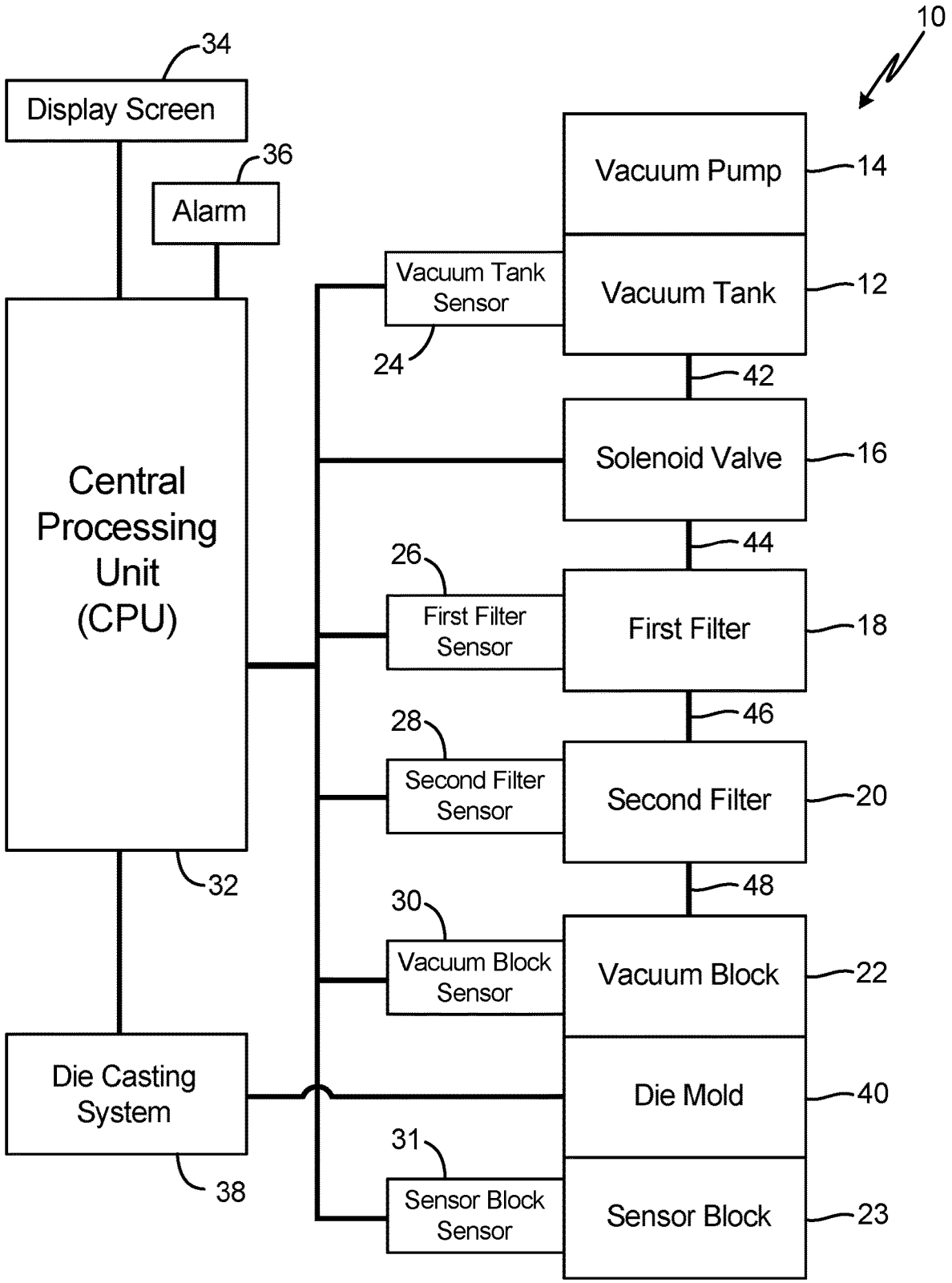
10
34
Display Screen
36
Alarm
Central Processing Unit (CPU)
32
Die Casting System
38
Vacuum Pump
14
Vacuum Tank Sensor
24
Vacuum Tank
12
42
Solenoid Valve
16
44
26
First Filter Sensor
First Filter
18
46
28
Second Filter Sensor
Second Filter
20
48
30
Vacuum Block Sensor
Vacuum Block
22
Die Mold
40
31
Sensor Block Sensor
Sensor Block
23

VACUUM SENSOR SYSTEM FOR HIGH PRESSURE DIE CASTING

CROSS-REFERENCE TO RELATED APPLICATION(S)

This application is a divisional of U.S. application Ser. No. 16/906,456 filed Jun. 19, 2020 for "VACUUM SENSOR SYSTEM FOR HIGH PRESSURE DIE CASTING", which in turn claims the benefit of U.S. Provisional Application No. 62/864,212 filed Jun. 20, 2019 are hereby incorporated by reference in their entirety.

BACKGROUND

This disclosure relates generally to a high-pressure die casting system. More specifically, this disclosure relates to a vacuum sensor system for a high-pressure die casting system.

Die casting is a metal casting process in which molten metal is forced under high-pressure into a mold or die cavity. The molten metal is forced into the die cavity under high-pressure to achieve a quick fill of the die mold in order to avoid any part of the casting solidifying before the entire cavity has been filled. Quickly filling the die cavity is beneficial in one aspect but also creates the problem of air entrapment in the die mold, because there is little time for the air to escape. Air entrapment creates porosity and other defects in the cast part, potentially resulting in a non-conforming part.

Vacuum die casting systems have been introduced to remove the air or other gases from the die cavity while the molten metal is being forced into the die-cavity, resulting in less porosity issues and higher quality parts. Over time, the vacuum die casting system becomes clogged with metal debris and die lube, causing the performance of the vacuum die casting system to degrade. Eventually, performance levels drop to the point in which porosity and other defects again become present in the cast parts. Once it has been determined that the vacuum system is clogged, the system must be disassembled to identify the location of the blockage. This process can be very time consuming and expensive because the blockage may only be found after non-conforming parts have been produced.

SUMMARY

According to one aspect of the invention, a vacuum sensor system for removing air or other gases from a die mold of a die casting system is disclosed. The vacuum sensor system includes a vacuum pump connected to a vacuum tank, a solenoid valve connected to the vacuum pump and the vacuum tank through a hose connection, and a vacuum block connected to the die mold. The vacuum block is configured to allow evacuation of air and other gases from a cavity of the die mold while trapping molten metal in the vacuum block. Further, the vacuum sensor system includes a vacuum tank sensor connected to the vacuum tank, wherein the vacuum tank sensor is configured to measure the vacuum pressure at the vacuum tank; a vacuum block sensor that is connected to the vacuum block and is configured to measure the vacuum pressure at the vacuum block; and a central processing unit (CPU) connected to the solenoid valve, the vacuum tank sensor, and the vacuum block sensor. The CPU is configured to gather vacuum pressure data from the vacuum tank sensor and the vacuum block sensor and compare the vacuum pressure data to determine whether vacuum pressure within the vacuum sensor system is decreasing, and wherein the CPU is configured to gather vacuum pressure data from the vacuum tank sensor and the vacuum block sensor and display the vacuum pressure data on a display screen.

According to another aspect of the invention, a method of monitoring a vacuum die casting system includes receiving, by a central processing unit (CPU), vacuum pressure data from a vacuum tank sensor connected to a vacuum tank; receiving, by the CPU, vacuum pressure data from a vacuum block sensor connected to a vacuum block; comparing, by the CPU, the vacuum pressure data from the vacuum tank sensor and the vacuum block sensor to determine whether vacuum pressure within the vacuum die casting system is decreasing; and displaying the vacuum pressure data on a display screen. Further, a vacuum pump is connected to the vacuum tank, the vacuum pump is configured to remove air or other gases from the die casting system. The vacuum block is connected to a die mold, the vacuum block is configured to allow evacuation of air and other gases from a cavity of the die mold while trapping molten metal in the vacuum block.

According to yet another aspect of the invention, a vacuum die casting system includes a die mold, a vacuum tank, a vacuum pump, a solenoid valve, a first filter, a second filter, a vacuum block, and a vacuum sensor system. The vacuum sensor system includes a vacuum tank sensor connected to the vacuum tank, wherein the vacuum tank sensor is configured to measure the vacuum pressure at the vacuum tank; a first filter sensor connected to the first filter, wherein the first filter sensor is configured to measure the vacuum pressure at the first filter; a second filter sensor connected to the second filter, wherein the second filter sensor is configured to measure the vacuum pressure at the second filter; a vacuum block sensor connected to the vacuum block, wherein the vacuum block sensor is configured to measure the vacuum pressure at the vacuum block; and a central processing unit (CPU) connected to the solenoid valve, the vacuum tank sensor, the first filter sensor, the second filter sensor, the vacuum block sensor, an alarm, a display screen, and the die casting system. The CPU is configured to gather vacuum pressure data from the vacuum tank sensor, the first filter sensor, the second filter sensor, and the vacuum block sensor and compare the vacuum pressure data to determine whether vacuum pressure within the vacuum die casting system is decreasing, if the gathered vacuum pressure has fallen to an insufficient level the CPU is configured to send a signal to initiate the alarm and also configured to send a signal to the die casting system to stop operation of the die casting system. The CPU is also configured to gather vacuum pressure data from the vacuum tank sensor, the first filter sensor, the second filter sensor, and the vacuum block sensor and display the vacuum pressure data on a display screen.

BRIEF DESCRIPTION OF THE DRAWINGS

FIG. 1 is a schematic of a vacuum sensor system attached to a die casting system.

DETAILED DESCRIPTION

FIG. 1 is a schematic of vacuum sensor system 10, which includes vacuum tank 12, vacuum pump 14, solenoid valve 16, first filter 18, second filter 20, vacuum block 22, and sensor block 23. Further, vacuum sensor system 10 includes vacuum tank sensor 24, first filter sensor 26, second filter sensor 28, vacuum block sensor 30, sensor block sensor 31, central processing unit (CPU) 32, display screen 34, and alarm 36. FIG. 1 also includes die casting system 38 and die mold 40.

Vacuum pump 14 is connected directly to vacuum tank 12 and is configured to remove air or other gases from die mold 40 through the interconnected components of vacuum sensor system 10. Vacuum tank 12 is connected to solenoid valve 16 through hose connection 42. Solenoid valve 16 is a standard solenoid valve configured to open and close, initiating or stopping vacuum pump 14 from removing air or other gases from die mold 40. CPU 32 is connected to solenoid valve 16 using standard connection means, and CPU 32 sends signals to solenoid valve 16 to control the opening and closing of solenoid valve 16. Solenoid valve 16 is also connected to first filter 18 through hose connection 44.

In the embodiment shown, first filter 18 is connected to both solenoid valve 16 and second filter 20 through hose connections 44 and 46, respectively. In another embodiment, vacuum sensor system 10 can include only first filter 18 and not second filter 20, in which first filter 18 would be connected to vacuum block 22 through a hose connection similar to hose connections 44 or 46. In the embodiment shown, first filter 18 is a mesh filter that is configured to catch soot like metal particles, die lube, and other debris from the die casting process. Second filter 20 is a baffle filter that is configured to catch soot like metal particles, die lube, and other debris from the die casting process. Second filter 20 is intended to catch primarily the soot like metal particles that are pulled through vacuum sensor system 10 during the die casting process, but second filter 20 can also catch the excess die lube and other debris being pulled through vacuum sensor system 10 by vacuum pump 14. Second filter 20 is connected in series with both first filter 18 and vacuum block 22 through hose connections 46 and 48, respectively.

Vacuum block 22 is connected to second filter 20 through hose connection 48 and also connected directly to die mold 40 through mounting features included in die mold 40. Vacuum block 22 is configured to allow evacuation of air and other gases from a cavity of die mold 40 while trapping molten metal in vacuum block 22 during the vacuum die casting process. In the embodiment shown, there is a single vacuum block 22 connected to die mold 40. In another embodiment, there can be a plurality of vacuum blocks 22 connected to die mold 40 through mounting features included in die mold 40. In the embodiment including a plurality of vacuum blocks 22, a manifold may be used to connect the plurality of vacuum blocks 22 to a single outlet hose that connects to second filter 20. The following description about vacuum sensor system 10 will focus on the embodiment shown in FIG. 1, in which vacuum sensor system 10 includes a single vacuum block 22.

In the embodiment shown in FIG. 1, vacuum sensor system 10 includes sensor block 23. In alternate embodiments, vacuum sensor system 10 does not include sensor block 23. Sensor block 23 is similar to vacuum block 22 in that the sensor block is connected directly to die mold 40 through mounting features. Sensor block 23 is configured to provide an access point on die mold 40 through which the vacuum pressure within the die cavity of die mold 40 can be measured.

In operation, vacuum pump 14 is initiated and begins removing air or other gases from vacuum sensor system 10. CPU 32 sends a signal to solenoid valve 16 to open solenoid valve 16, allowing vacuum pump 14 to remove air or other gases from the interconnected components of vacuum sensor system 10. First filter 18 and second filter 20 catch soot like metal particles, die lube, and other debris that is being pulled through the interconnected hoses of vacuum sensor system 10. Vacuum block 22 is connected directly to die mold 40 and allows evacuation of air and other gases from a cavity of die mold 40 while trapping molten metal in vacuum block 22. The components of vacuum sensor system 10 work in conjunction to ensure air or other gases are removed from the die cavity of die mold 40 while molten metal is being forced into the die cavity of die mold 40. Further, first filter 18, second filter 20, and vacuum block 22 are utilized to prevent debris from being pulled through vacuum sensor system 10 and clogging (and potentially damaging) solenoid valve 16 or vacuum pump 14. Removal of air or other gases from the die cavity of die mold 40 is essential to prevent porosity and other defects in the cast parts.

As shown in FIG. 1, vacuum sensor system 10 also includes vacuum tank sensor 24, first filter sensor 26, second filter sensor 28, vacuum block sensor 30, sensor block sensor 31, CPU 32, display screen 34, and alarm 36. Vacuum tank sensor 24 is connected to vacuum tank 12 and is configured to measure the vacuum pressure in vacuum tank 12. First filter sensor 26 is connected to first filter 18 and is configured to measure the vacuum pressure in first filter 18. Second filter sensor 28 is connected to second filter 20 and is configured to measure the vacuum pressure in second filter 20. Vacuum block sensor 30 is connected to vacuum block 22 and is configured to measure the vacuum pressure in vacuum block 22. Sensor block sensor 31 is connected to sensor block 23 and is configured to measure the vacuum pressure in die mold 40.

In the embodiment shown, vacuum tank sensor 24, first filter sensor 26, second filter sensor 28, and vacuum block sensor 30 are connected directly to their corresponding components of vacuum sensor system 10. In another embodiment, vacuum tank sensor 24, first filter sensor 26, second filter sensor 28, and vacuum block sensor 30 can be attached to the hoses used to connect the various components of vacuum sensor system 10. More specifically, vacuum block sensor 30 could be attached to hose 48 connecting vacuum block 22 and second filter 20; second filter sensor 28 could be attached to hose 46 connecting second filter 20 and first filter 18; first filter sensor 26 could be attached to hose 44 connecting first filter 18 and solenoid valve 16; and vacuum tank sensor 24 could be attached to hose 42 connecting solenoid valve 16 and vacuum tank 12. In yet another embodiment, vacuum tank sensor 24, first filter sensor 26, second filter sensor 28, vacuum block sensor 30, and sensor block sensor 31 could be both pressure and temperature sensors used to measure the pressure and temperature of each respective component of vacuum sensor system 10. The temperature sensors may be used to determine the temperature of the gasses that are being dissipated through the system during the die casting process, indicating the quality of the cast parts. The following description about vacuum sensor system 10 will focus on the embodiment shown in FIG. 1, in which vacuum sensor system 10 includes vacuum tank sensor 24, first filter sensor 26, second filter sensor 28, and vacuum block sensor 30 connected directly to their corresponding components.

CPU 32, of vacuum sensor system 10, is connected to vacuum tank sensor 24, solenoid valve 16, first filter sensor 26, second filter sensor 28, vacuum block sensor 30, sensor block sensor 31, display screen 34, alarm 36, and die casting system 38. CPU 32 is configured to receive/gather and store vacuum pressure data from vacuum tank sensor 24, first filter sensor 26, second filter sensor 28, vacuum block sensor 30, and sensor block sensor 31. Further, CPU 32 is configured to compare the vacuum pressure data to determine whether vacuum pressure within vacuum sensor system 10 is degrading or decreasing to a vacuum pressure level that is insufficient, resulting in porosity of cast parts. In one embodiment, CPU 32 is configured to compare the gathered vacuum pressure data from the plurality of sensors to a predefined value. The predefined value is the minimum vacuum pressure that is required during operation of the die casting process to avoid porosity and other defects in the final cast part. The predefined value will differ for each die mold 40, but this information can either be input into CPU 32 by the operator or automatically input into CPU 32 using previous test data. In another embodiment, CPU 32 is configured to compare the vacuum pressure differential between two components to determine whether vacuum pressure within vacuum sensor system 10 is degrading or decreasing. For example, CPU 32 could compare the differential vacuum pressure data between vacuum tank sensor 24 and first filter sensor 26, first filter sensor 26 and second filter sensor 28, second filter sensor 28 and vacuum block sensor 30, vacuum block sensor 30 and sensor block sensor 31, or any other combination to determine whether the vacuum pressure is decreasing. In either embodiment, CPU 32 is configured to compare the vacuum pressure data to determine whether vacuum pressure within vacuum sensor system 10 is degrading or decreasing to a vacuum pressure level that is insufficient, resulting in porosity or other defects of cast parts.

CPU 32 includes display screen 34 which can be a touchscreen display that controls the operation of CPU 32 and vacuum sensor system 10. Display screen 34 also displays the vacuum pressure data from the plurality of sensors for monitoring, control, and analysis purposes. In one embodiment, display screen 34 can display the real-time vacuum pressure data of each of the plurality of sensors of vacuum sensor system 10. In another embodiment, display screen 34 can display indicators showing the level of vacuum pressure within vacuum sensor system 10. More specifically, display screen 34 could have red, yellow, and green indicators representing sufficient vacuum level, degrading or decreasing vacuum level, and insufficient vacuum level, respectively.

CPU 32 can be connected through standard electrical connections to alarm 36 and die casting system 38. CPU 32 is configured to send a signal to initiate an alarm when CPU 32 determines that the vacuum pressure within vacuum sensor system 10 has fallen below the sufficient vacuum pressure level. Alarm 36 can be any standard alarm that includes visual and/or audible warning signals, for example a visual semaphore with an optional audible alarm. Further, CPU 32 is configured to send a signal to stop operation of die casting system 38 when CPU 32 determines that the vacuum pressure within vacuum sensor system 10 has fallen to an insufficient vacuum level. Die casting system 38 is connected to die mold 40 and die casting system 38 controls the die casting process. Die casting system 38 is configured to control when, how much, and how fast molten metal is injected into die mold 40. If CPU 32 determines that the vacuum pressure within vacuum sensor system 10 has fallen below the sufficient vacuum pressure level, CPU 32 can immediately stop operation of die casting system 38 to avoid wasting time and resources casting a part that the operators know will result in a cast part with porosity or other defects. CPU 32 can also send electronic notification to one or more users via email, text, or other form of telecommunication, notifying the user that the vacuum pressure within vacuum sensor system 10 has fallen below the sufficient vacuum pressure level.

Vacuum sensor system 10 monitors vacuum pressure at multiple points within a vacuum system to determine which components are clogging and causing loss of vacuum pressure within the system. Vacuum sensor system 10 monitors the performance of the system to ensure that the high-pressure die cast system will have greater yield of acceptable parts by confirming that the system maintains the proper level of vacuum pressure. If vacuum pressure within vacuum sensor system 10 falls below the sufficient vacuum pressure level, vacuum sensor system 10 can send signals to initiate an alarm and to stop the die casting process. Real-time monitoring of vacuum sensor system 10 provides the benefit of knowing when the vacuum system is underperforming and allows the operator to immediately stop the die casting process. This in turn saves time, money, and other resources because the full die casting process is not completed when it is known that the cast part is likely to have porosity or other defects.

DISCUSSION OF POSSIBLE EMBODIMENTS

The following are non-exclusive descriptions of possible embodiments of the present invention.

A vacuum die casting system for removing air or other gases from a die mold of a die casting system, the vacuum sensor system includes a vacuum pump connected to a vacuum tank; a solenoid valve connected to the vacuum pump and the vacuum tank through a hose connection; a first filter connected to the solenoid valve through a hose connection; a vacuum block connected to the die mold, the vacuum block is configured to allow evacuation of air and other gases from a cavity of the die mold while trapping molten metal in the vacuum block; a vacuum tank sensor connected to the vacuum tank, wherein the vacuum tank sensor is configured to measure the vacuum pressure at the vacuum tank; a vacuum block sensor connected to the vacuum block, wherein the vacuum block sensor is configured to measure the vacuum pressure at the vacuum block; and a central processing unit (CPU) connected to the solenoid valve, the vacuum tank sensor, and the vacuum block sensor; wherein the CPU is configured to gather vacuum pressure data from the vacuum tank sensor and the vacuum block sensor and compare the vacuum pressure data to determine whether vacuum pressure within the vacuum sensor system is decreasing, and wherein the CPU is configured to gather vacuum pressure data from the vacuum tank sensor and the vacuum block sensor and display the vacuum pressure data on a display screen.

The vacuum die casting system of the preceding paragraph can optionally include, additionally and/or alternatively, any one or more of the following features, configurations and/or additional components:

A second filter connected to the first filter through a hose connection.

A first filter sensor connected to the first filter and a second filter sensor connected to the second filter.

The solenoid valve is positioned between the vacuum tank and the first filter, the first filter is positioned between the solenoid valve and the second filter, the second filter is positioned between the first filter and the vacuum block, and the vacuum block is positioned between the second filter and the die mold of the die casting system.

The first filter is a mesh filter and the second filter is a baffle filter, and wherein the first filter and the second filter are connected in series.

The solenoid valve is configured to open and close, which initiates the vacuum pump and stops the vacuum pump from removing air or other gases from the die casting system, and wherein the CPU connected to the solenoid valve controls the opening and closing of the solenoid valve.

The first filter sensor is configured to measure the vacuum pressure at the first filter and the second filter sensor is configured to measure the vacuum pressure at the second filter.

The CPU is connected to the first filter sensor and the second filter sensor.

The CPU is configured to gather vacuum pressure data from the first filter sensor and the second filter sensor and compare the vacuum pressure data to determine whether vacuum pressure within the vacuum sensor system is decreasing, and wherein the CPU is configured to gather vacuum pressure data from the first filter sensor and the second filter sensor and display the vacuum data on the display screen.

The CPU is further configured to send a signal to initiate an alarm when the CPU determines that the vacuum pressure within the vacuum sensor system has fallen to an insufficient level, which would result in porosity in a cast part.

The CPU is connected to the die casting system that controls a die casting process; and wherein the CPU is configured to send a signal to stop operation of the die casting system when the CPU determines that vacuum pressure within the vacuum sensor system has fallen to an insufficient level, which would result in porosity in a cast part.

The comparing of the vacuum pressure data from the vacuum tank sensor, first filter sensor, second filter sensor, and vacuum block sensor includes comparing the vacuum pressure data to a predefined value, wherein the predefined value is minimum vacuum pressure level that is required during operation of a die casting process to avoid porosity and other defects in a cast part.

The comparing of the vacuum pressure data from the vacuum tank sensor, first filter sensor, second filter sensor, and vacuum block sensor includes comparing the differential vacuum pressure between the vacuum tank and the first filter, the first filter and the second filter, and the second filter and the vacuum block.

A sensor block connected to the die mold, the sensor block is configured to determine a vacuum pressure in the die mold, and a sensor block sensor connected to the sensor block, wherein the sensor block sensor is configured to measure the vacuum pressure at the sensor block.

A method of monitoring a vacuum die casting system, the method includes receiving, by a central processing unit (CPU), vacuum pressure data from a vacuum tank sensor connected to a vacuum tank; receiving, by the CPU, vacuum pressure data from a vacuum block sensor connected to a vacuum block; comparing, by the CPU, the vacuum pressure data from the vacuum tank sensor and the vacuum block sensor to determine whether vacuum pressure within the vacuum die casting system is decreasing; and displaying the vacuum pressure data on a display screen. A vacuum pump is connected to the vacuum tank, the vacuum pump is configured to remove air or other gases from the die casting system. The vacuum block is connected to a die mold, the vacuum block is configured to allow evacuation of air and other gases from a cavity of the die mold while trapping molten metal in the vacuum block.

The method of the preceding paragraph can optionally include, additionally and/or alternatively, any one or more of the following features, configurations and/or additional components:

The CPU sends a signal to initiate an alarm when the CPU determines that vacuum pressure within the vacuum die casting system has fallen to an insufficient level, which would result in porosity in a cast part.

The CPU is connected to the vacuum die casting system that controls a die casting process; and wherein the CPU sends a signal to stop operation of the vacuum die casting system when the CPU determines that vacuum pressure within the vacuum die casting system has fallen to an insufficient level, which would result in porosity in a cast part.

The CPU additionally receives vacuum pressure data from a first filter sensor connected to a first filter, wherein the CPU compares the vacuum pressure data from the first filter sensor to determine whether vacuum pressure within the vacuum die casting system is decreasing, and wherein the CPU displays the vacuum pressure data on the display screen; and a second filter sensor connected to a second filter, wherein the CPU compares the vacuum pressure data from the second filter sensor to determine whether vacuum pressure within the vacuum die casting system is decreasing, and wherein the CPU displays the vacuum pressure data on the display screen.

The solenoid valve is configured to open and close, which initiates the vacuum pump or stops the vacuum pump from removing air or other gases from the die casting system, and wherein the CPU is connected to the solenoid valve and controls the opening and closing of the solenoid valve.

The first filter is a mesh filter and the second filter is a baffle filter, and wherein the first filter and the second filter are connected in series.

The solenoid valve is positioned between the vacuum tank and the first filter, the first filter is positioned between the solenoid valve and the second filter, the second filter is positioned between the first filter and the vacuum block, and the vacuum block is positioned between the second filter and the die mold.

The solenoid valve is connected through a hose to the vacuum tank, the first filter is connected through a hose to the solenoid valve, the second filter is connected through a hose to the first filter, and the vacuum block is connected through a hose to the second filter.

The display screen is a touchscreen display that is configured to control the functions of the CPU and also to display the vacuum pressure data from the vacuum tank sensor, first filter sensor, second filter sensor, and vacuum block sensor.

The comparing of the vacuum pressure data from the vacuum tank sensor, first filter sensor, second filter sensor, and vacuum block sensor includes comparing the vacuum pressure data to a predefined value, wherein the predefined value is minimum vacuum pressure level that is required during operation of a die casting process to avoid porosity and other defects in a cast part.

The comparing of the vacuum pressure data from the vacuum tank sensor, first filter sensor, second filter sensor, and vacuum block sensor includes comparing the differential vacuum pressure between the vacuum tank and the first filter, the first filter and the second filter, and the second filter and the vacuum block.

A vacuum die casting system that includes a die mold, a vacuum tank, a vacuum pump, a solenoid valve, a first filter, a second filter, a vacuum block, and a vacuum sensor system. The vacuum sensor system includes a vacuum tank sensor connected to the vacuum tank, wherein the vacuum tank sensor is configured to measure the vacuum pressure at the vacuum tank; a first filter sensor connected to the first filter, wherein the first filter sensor is configured to measure the vacuum pressure at the first filter; a second filter sensor connected to the second filter, wherein the second filter sensor is configured to measure the vacuum pressure at the second filter; a vacuum block sensor connected to the vacuum block, wherein the vacuum block sensor is configured to measure the vacuum pressure at the vacuum block; and a central processing unit (CPU) connected to the solenoid valve, the vacuum tank sensor, the first filter sensor, the second filter sensor, the vacuum block sensor, an alarm, a display screen, and the die casting system; wherein the CPU is configured to gather vacuum pressure data from the vacuum tank sensor, the first filter sensor, the second filter sensor, and the vacuum block sensor and compare the vacuum pressure data to determine whether vacuum pressure within the vacuum die casting system is decreasing, if the gathered vacuum pressure data has fallen to an insufficient level the CPU is configured to send a signal to initiate the alarm and also configured to send a signal to the die casting system to stop operation of the die casting system; and wherein the CPU is configured to gather vacuum pressure data from the vacuum tank sensor, the first filter sensor, the second filter sensor, and the vacuum block sensor and display the vacuum pressure data on a display screen.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of monitoring a vacuum die casting system, the method comprising:

receiving, by a central processing unit (CPU), vacuum pressure data from a vacuum tank sensor connected to a vacuum tank;

receiving, by the CPU, vacuum pressure data from a vacuum block sensor connected to a vacuum block; and comparing, by the CPU, the vacuum pressure data from the vacuum tank sensor and the vacuum pressure data from the vacuum block sensor to determine whether vacuum pressure within the vacuum die casting system is decreasing;

wherein a vacuum pump is connected to the vacuum tank, the vacuum pump is configured to remove air or other gases from the die casting system; and wherein the vacuum block is connected to a die mold, the vacuum block is configured to allow evacuation of air and other gases from a cavity of the die mold while trapping molten metal in the vacuum block.

2. The method of claim 1, wherein the comparing of the vacuum pressure data from the vacuum tank sensor and the vacuum block sensor includes comparing the vacuum pressure data to a predefined value.

3. The method of claim 2, wherein the predefined value is minimum vacuum pressure level required during operation of a die casting process to avoid porosity and other defects in a cast part.

4. The method of claim 1, wherein the comparing of the vacuum pressure data from the vacuum tank sensor and the vacuum block sensor includes comparing the differential vacuum pressure between the vacuum tank the vacuum block.

5. The method of claim 1, and further comprising:

displaying the vacuum pressure data on a display screen; and sending, by the CPU, a signal to initiate an alarm when the CPU determines that vacuum pressure within the vacuum die casting system has fallen to an insufficient level.

6. The method of claim 5, wherein the display screen is a touchscreen display that is configured to control the functions of the CPU and also to display the vacuum pressure data.

7. The method of claim 1, wherein:

the CPU is connected to the vacuum die casting system that controls a die casting process; and the CPU sends a signal to stop operation of the vacuum die casting system when the CPU determines that vacuum pressure within the vacuum die casting system has fallen to an insufficient level.

8. The method of claim 1, wherein the CPU additionally receives vacuum pressure data from:

a first filter sensor connected to a first filter, wherein the CPU compares the vacuum pressure data from the first filter sensor to determine whether vacuum pressure within the vacuum die casting system is decreasing; and a second filter sensor connected to a second filter, wherein the CPU compares the vacuum pressure data from the second filter sensor to determine whether vacuum pressure within the vacuum die casting system is decreasing.

9. The method of claim 8, wherein the first filter is a mesh filter and the second filter is a baffle filter, and wherein the first filter and the second filter are connected in series.

10. The method of claim 8, wherein a solenoid valve is configured to open and close, initiating or stopping the vacuum pump from removing air or other gases from the die casting system, and wherein the CPU is connected to the solenoid valve and controls the opening and closing of the solenoid valve.

11. The method of claim 10, wherein the solenoid valve is positioned between the vacuum tank and the first filter, the first filter is positioned between the solenoid valve and the second filter, the second filter is positioned between the first filter and the vacuum block, and the vacuum block is positioned between the second filter and the die mold.

12. The method of claim 11, wherein the solenoid valve is connected through a hose to the vacuum tank, the first filter is connected through a hose to the solenoid valve, the second filter is connected through a hose to the first filter, and the vacuum block is connected through a hose to the second filter.

13. The method of claim 8, wherein the comparing of the vacuum pressure data from the vacuum tank sensor, first filter sensor, second filter sensor, and vacuum block sensor includes comparing the vacuum pressure data to a predefined value.

14. The method of claim 13, wherein the predefined value is minimum vacuum pressure level required during operation of a die casting process to avoid porosity and other defects in a cast part.

15. The method of claim 8, wherein the comparing of the vacuum pressure data includes:

comparing, by the CPU, a differential vacuum pressure between the vacuum tank and the first filter; and identifying, by the CPU, a decrease in vacuum pressure between the first filter and the vacuum tank.

16. The method of claim 8, wherein the comparing of the vacuum pressure data includes:

comparing, by the CPU, a differential vacuum pressure between the first filter and the second filter; and identifying, by the CPU, a decrease in vacuum pressure between the second filter and the first filter.

17. The method of claim 8, wherein the comparing of the vacuum pressure data includes:

comparing, by the CPU, a differential vacuum pressure between the second filter and the vacuum block; and identifying, by the CPU, a decrease in vacuum pressure between the vacuum block and the second filter.

18. The method of claim 1 and further comprising receiving, by the CPU, vacuum pressure data from a sensor block sensor connected to a sensor block that is coupled to the die mold.

19. The method of claim 18 and further comprising comparing, by the CPU, the vacuum pressure data from the sensor block sensor to the vacuum pressure data from the vacuum block sensor to determine whether vacuum pressure within the vacuum die casting system is decreasing.

20. The method of claim 1, and further comprising sending an electronic notification to one or more users via email, text, or push-notification, notifying the user that the vacuum pressure within the system has fallen to an insufficient vacuum pressure level.

* * * * *